United States Patent [19]

Fidchunov et al.

[11] 4,071,414

[45] Jan. 31, 1978

[54] METHOD OF SMOKELESS CHARGING OF COKE OVENS WITH COAL CHARGE AND COAL-CHARGING MACHINE FOR EFFECTING SAME

[76] Inventors: Leonid Nikolaevich Fidchunov, pereulok Traktorostroitelei 85, kv. 205; Stanislav Sergeevich Balyk, ulitsa Potebni, 8, kv. 7; Adolf Nikolaevich Silka, ulitsa Kostomarovskaya, 5/7, kv. 15; Nikolai Konstantinovich Kulakov, ulitsa Danilevskogo, 14a, kv. 21, all of Kharkov; Leonid Fedorovich Bakhtarov, ulitsa Nevskogo, 5, kv. 9, Lipetsk; Alexandr Abramovich Azimov, Donetskoi oblasti, bulvar Pushkina, 3, kv. 60, Slavyansk; Vladimir Mikhailovich Davydenko, Donetskoi oblasti, ulitsa Oktyabrskoi revoljutsii, 47, kv. 5, Slavyansk; Nikolai Vasilievich Balitsky, Donetskoi oblasti, ulitsa Bulvarnaya, 7, kv. 21, Slavyansk; Evgeny Petrovich Likhogub, ulitsa Kommunalnaya, 41, kv. 97, Kharkov; Gersh Abramovich Dorfman, ulitsa Dmitrievskaya, 20, kv. 10, Kharkov, all of U.S.S.R.

[21] Appl. No.: 664,065

[22] Filed: Mar. 5, 1976

[51] Int. Cl.[2] ..... C10B 31/04; C10B 37/02; C10B 53/04

[52] U.S. Cl. ..... 201/40; 202/248; 202/262; 202/263; 214/18 PH

[58] Field of Search ..... 201/40; 202/262, 263, 202/248; 214/18 PH, 35 R, 36

[56] References Cited

U.S. PATENT DOCUMENTS

| | | | |
|---|---|---|---|
| 1,814,184 | 7/1931 | Pavitt | 201/40 |
| 1,900,753 | 3/1933 | Becker | 201/40 |
| 3,542,650 | 11/1970 | Kulakov | 201/40 |
| 3,623,959 | 11/1971 | Knappstein | 201/40 |
| 3,791,320 | 2/1974 | Gidick | 214/18 PH |
| 3,857,758 | 12/1974 | Mole | 201/40 |

*Primary Examiner*—Morris O. Wolk
*Assistant Examiner*—Michael S. Marcus
*Attorney, Agent, or Firm*—Fleit & Jacobson

[57] ABSTRACT

A method of smokeless charging of coke ovens with coal charge in which coal is poured into each chamber of the coke oven in two stages: firstly coal charge is loaded into the oven chamber through extreme holes and charging gases liberated during said operation are discharged simultaneously, the loaded coal charge is held within the oven, after which the latter is replenished to capacity with coal charge through central holes, charging of the oven which is next in terms of the charging schedule and replenishing of the preceding one being effected simultaneously.

A coal-charging machine for realizing the method of smokeless charging of coke ovens with coal charge in which machine hoppers, comprising receiving and discharging devices, are made so that the centers of the outlets of the discharging devices of the extreme hoppers are displaced in the direction of travel of the coal-charging machine with respect to those of the discharging devices of the central hoppers for a value which is a multiple of the distance between the longitudinal axes of the neighboring coke ovens.

7 Claims, 18 Drawing Figures

METHOD OF SMOKELESS CHARGING OF COKE OVENS WITH COAL CHARGE AND COAL-CHARGING MACHINE FOR EFFECTING SAME

The present invention relates to coke chemical industry and more particularly to methods of charging horizontal coke ovens with coal charge and devices for effecting same.

According to the basic prior-art method of charging horizontal coke ovens, coal charge is poured alternately into coke ovens (in one after the other, according to an adopted schedule) through charging holes provided in oven roofs. Usually there are three, four and less frequently five or more charging holes in each coke oven, depending on charge characteristics, oven system and size. All the charging holes are disposed along an axis passing in a vertical axial plane of the coke oven. Several dozens of said coke ovens are arranged mutually parallel to form a battery. The coal charge taken from bunkers of a coal bin is transferred to the coke ovens to be charged by means of coal-charging machines comprising charge hoppers. The machines travel on tracks laid on the top of the oven battery. Usually the number of machine hoppers corresponds to that of the oven charging holes, all the hoppers being always arranged on the machine in one plane parallel to the longitudinal axis of the coke oven.

The process of transferring coal charge from machine hoppers into a coke oven, termed over charging, is a combination of responsible technological operations. Since the charge is poured into a coke oven whose walls are heated to a temperature of 1100° C and over, coal destruction results in immediate intense liberation of a large amount of gases evolving from the charge. These gases carry over a large amount of coal dust and particulate charge coming out of the oven as smoke. Various charging techniques are in use to preclude the discharge of these gases into the atmosphere and carry-over into gas collectors with which every oven communicates by means of gas-discharging devices which are ascension pipes.

Thus, smoke emission into the atmosphere is precluded and charging gases are withdrawn mainly by sequential discharging of the hoppers of the coal-charging machines. This technique is also resorted to with three-hole ovens, as well as with the ovens fitted with four, five or more charging holes.

As a rule, the charge is firstly dropped from an extreme machine hopper. When the charge from this hopper is transferred completely into the oven, the other extreme hopper is discharged and after that the central one, in case of a three-hopper machine, is emptied. If a coal-charging machine with four, five or more hoppers is employed, the charge from said hoppers is also unloaded sequentially, the hoppers being discharged one after the other. In this case a general charging rule in force is: the charge from each next hopper is dropped only after the preceding hopper, in terms of the charging schedule, has been completely emptied, its coal charge comming into the coke oven.

This technique is necessary to preclude intense charging gas emission into the atmosphere. It is also associated with the fact that coal charge, as it drops from the hoppers, forms cone peaks in the oven distributing at an angle of repose, the cone apex being arranged under the centre of the charging hole. As a result, there are valleys in the oven not filled with the charge, through which valleys the gases evolved from the charge escape. The gases are discharged through the uprisers arranged on on both sides of the coke oven.

An ascension pipe is a vertical pipe mounted in an oven roof and connected through a reducing elbow to a gas collector. The ascension pipe is fitted with a cover, set up on the pipe, and with a valve with a water seal, said valve being arranged in the elbow. When charging coal, the upriser cover is opened and charging gases are ejected into the atmosphere or discharged into gas-purifying devices, the valve being closed at this time to cut off thereby the coke oven from the gas collecting main. This is necessary to preclude the ingress into the gas collecting main of dust-laden gas liberated from the coal charge loaded into the coke oven.

To intensify the process of gas discharge use is made of an ejection effect of a steam jet fed into the ascension pipes in the direction of gas flow. At the same time that the charge is dropped from the central hopper (or central hoppers) of the coal-charging machine, charge leveling in the oven is effected to provide better gas circulation during the coking operation that follows and to rule out the clogging of charging holes with coal charge.

A serious disadvantage of this method resides in that only one coke oven is charged during one working cycle, in view of which its charging time is great, ranging from 35 to 55 or more percent of the machine time of the entire service cycle on one oven. The term "cycle" is commonly used to denote the time required to a coal-charging machine for effect the entire range of technological operations, i.e., loading the charge into the machine hoppers from the coal bin bunkers, handling the charge to the coke oven, manipulating with the ascension pipes and charging lids of the oven being charged, dropping (charging) the coal from the machine hoppers into the coke oven, spotting the machine under the coal bin to load a new batch of coal charge, as well as setting-up the next coke oven for charging. This disadvantage is directly related to the the fact that the charging operation and the evacuation of charging gases are time-dependent operations.

Naturally, the design of the coal-charging machine, as well as the arrangement of coal hoppers thereon are determined by the adopted classical oven charging technique. The disadvantage of said method and, hence, of the design of the coal-charging machine diminish materially the yield of an oven battery, since a long duration of the total service cycle of one coke oven, especially of its charging, imposes a limitation on the number of coke ovens serviced by one set of coke oven machines.

Known in the art are other methods of oven charging. Thus, with a view to cutting down the oven charging time, the coke-oven and by-product plants often resort in practice to speeding-up of the charging operation, this being done by dropping the charge from each next (in terms of the charging schedule) hopper into one coke oven before the preceding hopper has been completely emptied, or dropping the charge concurrently from two and more hoppers. Such speeding-up, however, results in the disturbance of the technological conditions of the ovens, an intense increase in the volume of gas and dust emission from the oven and in oven underloading.

Also known is another method of oven charging, wherein coal charge is loaded into coke ovens by pipes.

This charging process does not involve the use of a coal-charging machine, the coal charge being transferred in succession to each oven by the pipes with the aid of a carrier which may be inert gases, steam, etc. A serious disadvantage of said method lies in that it is adaptable for charging ovens only with preliminary slightly dried charge. Moreover, a large amount of the carrier at a temperature much lower than that of oven walls is blown into the coke oven together with coal charge. This results not only in early failure of the coke ovens due to abrupt supercooling during charging but in an excess increase in the volume of gases and dust to be evacuated from the oven. This method has not yet exceeded the limits of experiments and has not found extensive application in industry.

Thus, the above outlined methods of charging coke ovens, as well as the designs of coal-charging machines adapted for effecting said methods have come in conflict with the modern requirements, as to the yield of coke oven batteries, gas and dust emission control and oven charging time. Moreover, the disadvantages peculiar to classical charging technique restrain the possibilities of mechanization and automation of technological operations involved in oven charging.

The main object of the invention is the provision of a method of charging coke ovens with coal charge and of a coal-charging machine for effecting said method which allows cutting down oven charging time and enhancing their yield.

This object is achieved, according to the invention, by the fact that in a method of smokeless charging of coke ovens with coal charge, the oven is charged in two stages, the coal charge being poured into the coke oven through its charging holes by means of a coal-charging machine, comprising charge hoppers.

At first, coal charge is poured into the first empty oven, in terms of the charging schedule, charging being effected through the extreme oven holes. The coal charge is held in the coke oven over a period of time needed to handle coal charge for the oven which is the next in terms of the charging schedule, whereupon the coke oven is replenished to capacity through the central charging holes. In this case the oven which is next in terms of the charging schedule is charged with coal through the extreme holes simultaneously with replenishing pouring of coal charge through the central charging holes of the preceding (in terms of the charging schedule) oven.

It is expedient that replenishing of the coke oven with coal charge and leveling it therein be done simultaneously.

This method makes it possible to cut down considerably the charging time needed for loading coal charge into coke ovens per cycle. Since each coke oven is charged in two stages and the charging process is effected simultaneously on two ovens, the oven which is next in terms of the charging schedule being charged through the extreme holes and the preceding one, also in terms of the charging schedule, through the central charging holes, both operations are carried out simultaneously. Holding of coal charged through the extreme holes of the oven which is the next in terms of the charging schedule over a time period that is necesary for carrying coal charge to load it into the next (in terms of the charging schedule) oven contributes to slight compacting of coal charge. Vigorous liberation of gases in this oven will be ceased and the charging dust, as well as the particles of coal charge, will settle down in the oven. This will improve gas circulation conditions. Replenishing of the coke oven through its central charging holes will enable the volume of coal charged per one cycle into one coke oven to be increased. The replenishing time can be brought to that required for oven charging through its extreme holes, a feature that improves the gas discharging conditions and provides a higher quality leveling of coal charge and its compacting.

These advantages make is possible to cut down the oven operating cycle by decreasing their charging time, and to enhance their yield. By maintaining the former rate of operation of the coke oven machines, the number of coke ovens in a battery can be increased. Moreover, since gas and dust emission into the atmosphere diminishes materially, because in two-stage charging the oven is detached from the gas collectig main and communicates with the atmosphere over a smaller period of time, the effect of smokeless charging becomes especially manifest.

The present invention may be realized with the aid of a machine for loading coal charge (referred to hereinafter as a coal-charging machine), comprising charge hoppers fixed on a frame with an undercarriage, said machine travelling over a coke oven battery. Coal charge is taken into the machine hoppers from the bunkers of a coal bin, the latter (coal bin bunkers) being arranged in several rows. Each hopper of the coal-charging machine has in its top portion a receiving device and in its bottom portion a coal discharging device. According to the invention, the centres of the outlets of the discharging devices of the extreme machine hoppers are displaced in the direction of machine travel with respect to those of the central hoppers for a value which is a multiple of a distance between the longitudinal axes of the adjacent coke ovens, i.e. of a distance between the axes of the coke oven being charged and that being replenished.

Since in oven charging the centres of the outlets of the discharging devices of the extreme hoppers are displaced in the direction of machine travel with respect to those of the central hoppers, two coke ovens can be charged simultaneously which cuts down considerably the charging cycle as both said operations are carried out at the same time without respotting the machine at the ovens being charged.

This factor contributes to a more simplified design of the coal-charging machine, enables more extensive application of said machines and makes them more versatile.

The machine design, according to this embodiment, is also characterized in that the displacement of the centres of the inlets of the receiving device with respect to those of the outlets of the discharging devices of the extreme hoppers and the displacements of said openings of the central hoppers are in a certain mathematical relationship derived by us. This relationship allows determining easily the parameters discussed below and, hence, arranging the machine hoppers in accordance with the charging schedule adopted for the coke ovens, so that their arrangement will satisfy the charging conditions according to the invention. Angles of inclinations of hopper walls will slightly exceed the angle of repose of the coal charge, this precluding the hangup of the charge in the hoppers and ensuring its rapid dropping and enhancing the charging efficiency.

In the proposed coal-charging machine, the centres of the inlets of the receiving devices in the extreme hoppers are displaced with respect to those of the outlets of the discharging devices of said extreme hoppers, the centres of said inlets of the receiving devices in the central hoppers being also displaced with respect to those of the outlets of the discharging devices, said displacement being expressed as:

$$S_1 = K_1h \pm S_2 \pm K_2H,$$

where $S_1$ is the displacement of the centre of the inlet in the receiving device with respect to that of the outlet in the discharging device of the central hopper;

$S_2$ is the displacement of the centre of the inlet of the receiving device with respect to that of the outlet of the discharging device in the extreme hopper;

$K_1$ is a coefficient depending on the charging schedule adopted for the coke ovens and a multiple of the distance between the longitudinal axes of the adjacent coke ovens;

$K_2$ is a coefficient taking into account the number of rows of coal bin gates through which the charge is taken simultaneously into the coal-charging machine hoppers, said coefficient being equal to zero or a multiple of the distance between the axes of the neighboring rows of the coal bin bunkers;

$h$ is the distance between the longitudinal axes of the adjacent coke ovens; and $H$ is the distance between the axes of the neighboring rows of the coal bin bunkers.

A feature of the invention is also a possibility of various embodiments of the coal-charging machine hoppers. The extreme hoppers are advisable to be made inclined and the central ones vertical so that the centres of the inlets of the receiving devices in all the hoppers lie in one vertical plane passing through the longitudinal axis of the coke oven. This embodiment satisfies the coke oven charging condition according to the invention, affords the possibility of loading coal charge under one row of the coal bin bunkers and simplifies the design of the central hoppers, especially for four- and five-hopper coal-charging machines. It also improves the charge dropping conditions.

The extreme hoppers can also be made vertical, the central one being in this case inclined. If that is the case, the centres of the inlets of the receiving devices of all the hoppers lie in one vertical plane. This embodiment improves substantially the charge dropping conditions for the extreme hoppers of the coal-charging machines, and the hopper design is the simpliest in this case.

It is expedient that the extreme and central hoppers be inclined so that the centres of the inlets of the receiving hoppers of both the extreme and central hoppers lie in two vertical planes, parallel to the longitudinal axis of the coke oven, the distance between said planes being a multiple of that between the axes of the neighboring rows of the coal bin bunkers.

This embodiment also satisfies the oven charging conditions and enables the coal-charging machine hoppers to be filled with charge taken simultaneously from two rows of the coal bin bunkers. In this case the hoppers become interchangeable and are similar in shape.

Thus, each of the proposed hopper embodiments satisfies the oven charging conditions according to the invention, and affords the possibility of coping with a range of additional problems: charging coal into the machine hoppers from one or two rows of the coal bin bunkers; assuring simple configuration of the hoppers; providing better charge dropping conditions; ensuring economically more efficient utilization of the machine frame working stage to arrange equipment thereon, a feature which adds to versatility of the coal-charging machines.

The nature of the invention will be clear from the following detailed description of a particular embodiment of a method of smokeless charging of coke ovens with coal charge by means of a coal-charging machine, to be had in conjunction with the accompanying drawings, in which.

The essence of the proposed method of smokeless charging of coke ovens with coal charge by means of a three-hopper machine adapted for loading coal (referred to hereinafter as a coal-charging machine) will be more clear from a description that follows, this, however, not limiting the use of the proposed method to three-hopper coal-charging machines.

Figure 1:
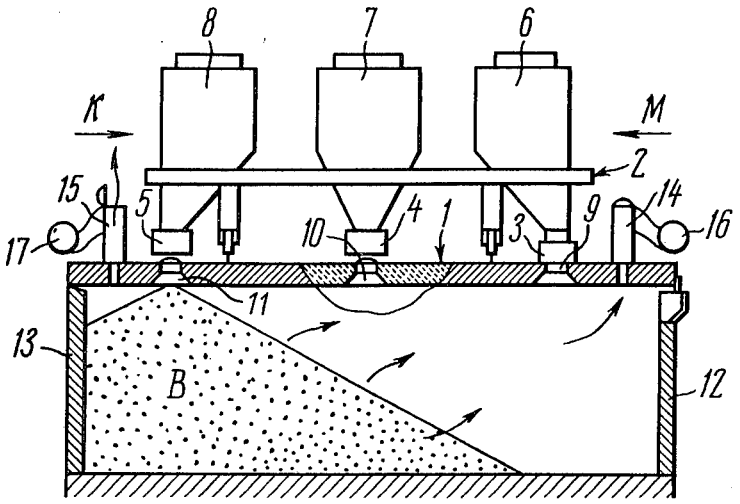
FIG. 1 shows mutual arrangement of a coke oven and a three-hopper coal-charging machine oven charging through an extreme charging hole on the coke side, and the charge distribution pattern within the oven.
Figure 2:
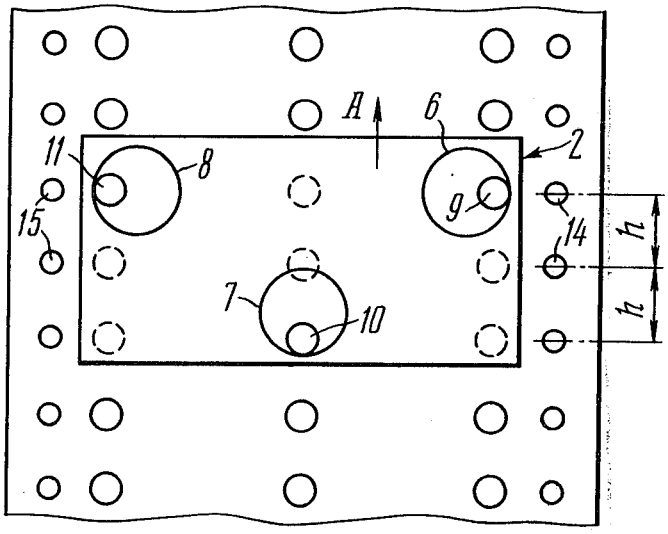
FIG. 2 is the top view of a coal-charging machine as shown in FIG. 1.

To charge a coke oven 1 with coal charge a coal-charging machine 2 is spotted over the oven so that the centres of the outlets of discharging devices 3, 4 and 5 of its appropriate hoppers 6, 7 and 8 will coincide with those of charging holes 9, 10 and 11 of the coke oven 1 (FIGS. 1, 2). In this case as the centres of the outlets of the discharging devices 3 and 5 of the extreme hoppers 6 and 8, respectively, are displaced during charging in the direction of travel of the machine 2 (in FIG. 2 the direction of travel of the coal-charging machine is indicated by arrow A), they will coincide with the centres of the extreme charging holes 9 and 11 of the next oven being charged, whereas the centre of the outlet of the discharging device 4 of the central hopper 7 will coincide with that of the central charging hole 10 of the preceding oven, in terms of the charging schedule. As is commonly known, prior to charging, oven doors 12 and 13 on the machine and the coke ends of the oven battery respectively, as well as the lids of the charging holes 9, 10 and 11 must be closed. In this case the term "machine end" indicated in the drawing by arrow M denotes the oven battery end wherein a coke pusher (not shown in the drawing) is arranged, whereas "the coke end or side" indicated by arrow K denotes the oven battery end in which a coke-quenching car (not shown in the drawing) is mounted adapted to receive resultant coke from the coke oven.

Coal charge from the hoppers 6, 7, 8 of the coal-charging machine is dropped into each coke oven 1 in two stages. At first the next empty oven 1 (FIG. 1) is charged through the extreme charging holes 9 and 11 from the extreme hoppers 6 and 8 of the coal-charging machine 2. According to the adopted practice, prior to charging, the lids of the charging holes 9 and 11 are removed, the discharging devices 3, 5 of the machine hoppers 6 and 8 are lowered on said holes 9 and 11; the gates of the these hoppers 6 and 8 are opened and the charge flows by gravity into the coke oven 1 distributing within the oven at an angle of respose. In this case the charge can be dropped either simultaneously from both extreme hoppers 6 and 8 or they can be dropped sequentially, e.g., dropping the charge firstly from the hopper 8 on the coke end of the battery and then from the hopper 6 on the machine end of the battery or vice versa.

Figure 3:
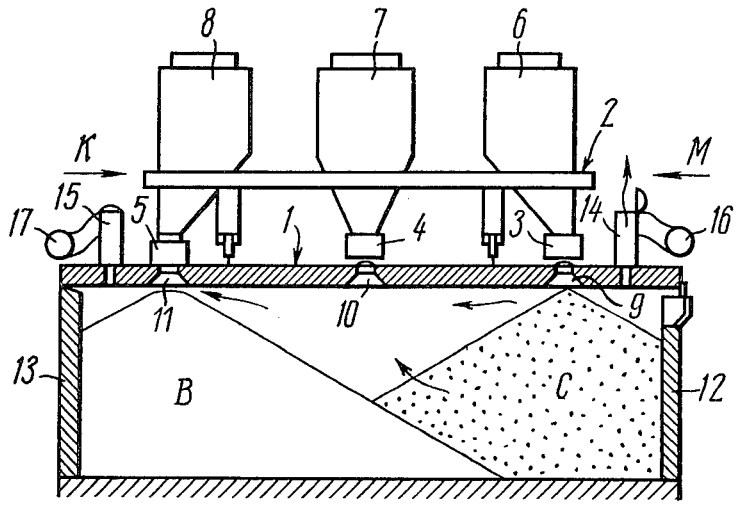
FIG. 3 shows the mutual arrangement of a coke oven and a three-hopper coal-charging machine oven charging through an extreme charging hole on the machine side, and the charge distribution pattern in the oven.

In this case charging gases evolved from the coal loaded into the coke oven 1 are withdrawn into ascension pipes 14, 15 located respectively on the machine and coke ends of each coke oven 1. In case of sequential dropping of charge from the extreme hoppers 6 and 8 of the coal-charging machine 2 the direction of gas flow in the coke oven 1 is changed periodically. Thus, when the charge comes off the extreme hopper 8 on the coke end of the battery, the gases are discharged through the ascension pipe 14 on the machine side of the oven battery, whereas when the charge comes off firstly from the extreme hopper 6 on the machine end of the battery, they are withdrawn through the ascension pipe 15 on the coke side of the oven battery. The sequence of said operations, as well as the charge distribution pattern in the coke oven when charging through the extreme holes, is shown in FIGS. 1 and 3.

The first batches of the charge distribute in the coke oven 1 as cones "B" and "C" (FIG. 3) with valleys therebetween not filled with charge. The gases evolved from the charge escape to said valleys. The gases are discharged to the atmosphere through the ascension pipes 14 and 15 connected to common gas collecting mains 16 and 17. The gases can be also discharged through the outlets of the hopper discharging devices 3, 4 and 5 into means for purifying said gases from dust (not shown in the drawing) located on the coal-charging machine 2.

The coal charged through the extreme holes 9 and 11 into the coke oven 1 is held over a time period that is needed to handle the charge for loading the oven which is next in terms of the charging schedule. To this end the coal-charging machine 2 is spotted under the coal bin (not shown in FIGS. 1 through 4) and the hoppers 6, 7, 8 of said machine 2 are filled with coal charge. Then the coal-charging machine 2 is carried from under the coal bin to the oven which is the next in terms of the charging schedule and spotted above the charging holes of said oven, as outlined above. In this case the discharging device 4 of the central hopper 7 (FIG. 4) is lowered on the central hole 10 of the oven 1 under consideration and the charge is poured into the coke oven 1 to fill it to capacity.

Replenishing of the coke oven 1 to provide full charge thereon is effected simultaneously with the leveling of charge. To this end a leveling device 19, e.g. a coke pusher leveler bar, is introduced into the coke oven 1 through a hatchway 18 in the coke oven door 12 disposed on the machine side of the oven battery. In the course of replenishing, the gases libered due to coal destruction are withdrawn through the ascension pipes 14 and 15, said gases entraining dust and charge particles. To preclude their emission to the atmosphere the gas discharge rate is increased by ejecting them with water vapors introduced into the ascension pipes 14 and 15 with the aid of sprayers (not shown in the drawings).

Figure 4:
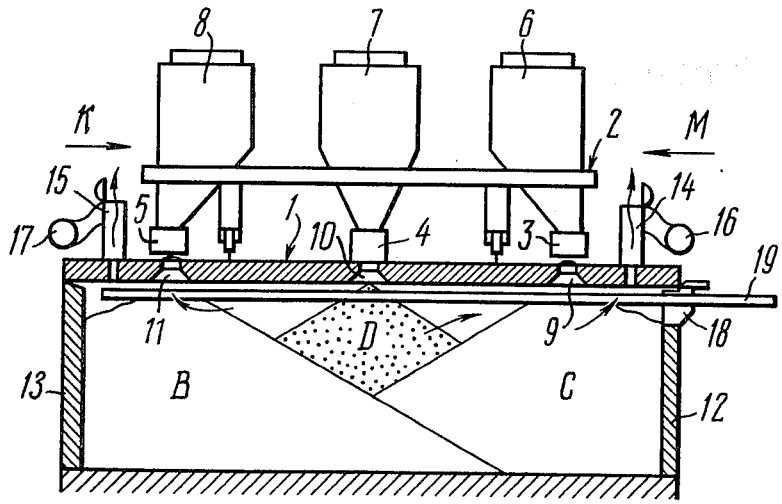
FIG. 4 shows the mutual arrangement of a coke oven and a three-hopper coal-charging machine in replenishing the oven through the central charging hole and charge leveling, and the charge distribution pattern within the coke oven.

When replenishing the oven to capacity, the coal charge is distributed as a cone "D" (FIG. 4). The valleys not filled with charge serve also for gas evacuation from the oven, the gases being discharged through both ascension pipes 14 and 15 of said oven 1. When charging the second coal batch (during replenishing), the leveling device 19 reciprocating within the oven destructs the peaks B, C and D and the charge is uniformly distributed all along the length of the oven 1 forming a flat surface shown by a wavy line in FIG. 4. As a result, the gases generated due to coal destruction over the entire coking period escape through a tunnel, that remains between the roof of the coke oven 1 and the coal line, into the ascension pipes 14 and 15.

Thus, the oven 1 is replenished to capacity through the central charging hole 10, this being effected simultaneously with the charging of the next (in terms of the charging schedule) oven which is carried out through its extreme holes 9 and 11.

In the interval between the first and second charging of each oven 1, i.e. during the so-called technological pause, the charge loaded into the oven 1 through the two extreme holes 9 and 11 is compacted and vigorous evolution of gases from it ceases. Dust and charge particles settle down in the oven and the coal destruction process is initiated.

Operational experience of many coke-oven and by-product plants has determined optimum relationships of hopper volumes on a coal-charging machine adapted for charging coal into coke ovens through their charging holes. Thus, with a three-hopper system the total volume of all the machine hoppers must be equal to 125–130% of the volume of a coke oven, and the combined volume of the extreme machine hoppers must be equal to 75–80% of the total volume of the hoppers.

However, the principle of charging a minimum amount of charge into coke ovens through the central holes with simultaneous leveling of said charge holds true for four- and five-hopper coal-charging machines as well.

A higher efficiency of the charging process, and a substantial reduction in gas and dust emission to the atmosphere, is assured because charging by the proposed method takes less time as compared with the prior-art procedures, by which virtue a lower amount of charging gases is liberated along with a lower dust and charge carry-over. When charging concurrently two ovens, and discharging gases simultaneously from the two ovens, charge and gas flows are redistributed, and the charge comes off the machine hoppers more uniformly, and its dust-raising capacity and gas emission rate diminish. Two-stage charging of each oven ensures better compacting of the charge (before replenishing the oven to capacity) with an ensuing increase in the amount of coal charged in one pass. A reduction in the charging time allows cutting down the cycle of service operations per oven, as well as the total oven cycle operations and increasing the number of ovens in a coke oven battery, provided the adopted intensity of operation of the coke machines is not changed.

The above-outlined method of charging coke ovens with coal-charge can be realized by using a four-hopper coal-charging machine.

Figure 5:
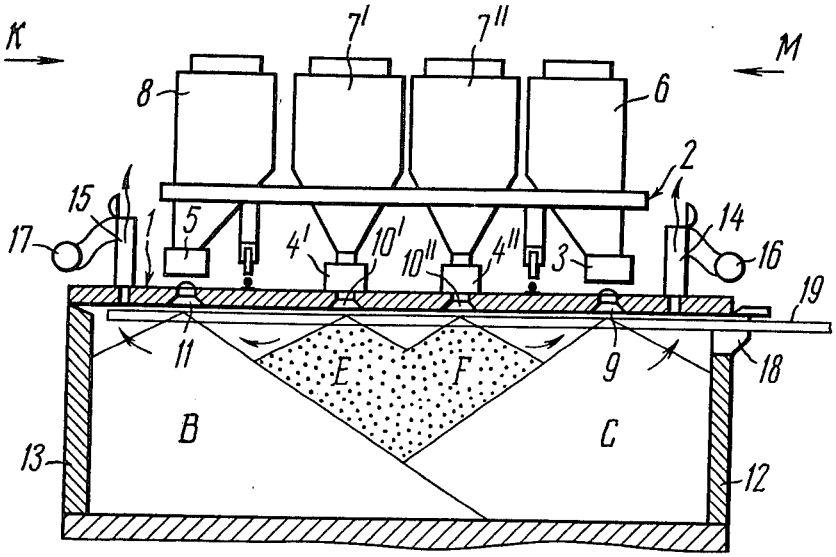
FIG. 5 shows the mutual arrangement of a coke oven and a four-hopper coal-charging machine in oven charging, and the charge distribution pattern within the coke oven.
Figure 6:
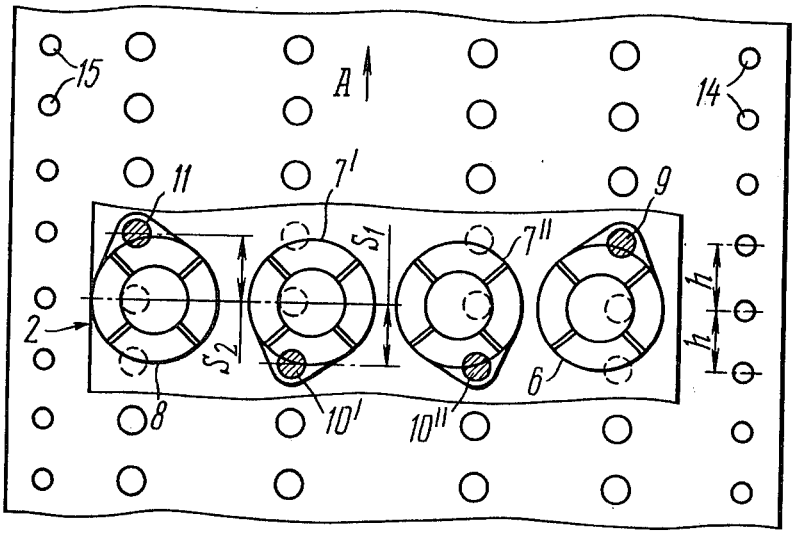
FIG. 6 is a top view of a coal-charging machine shown in FIG. 5.

The charging operation differs from the above outlined process in that the charge comes into the oven being replenished simultaneously from two central hoppers 7′ and 7″, as shown in FIGS. 5, 6. In this case the charge loaded into the oven forms two peaks "E" and "F", this slightly impairing gas discharge from the oven but providing a more uniform distribution of charge along the length of the oven and better compacting. As in the preceding examplary embodiment, replenishing through the central holes is effected simultaneously with leveling.

The present invention is not limited to the disclosed paritcular embodiments. Thus, in case of a five-hole oven, charging according to the proposed method must be accomplished by a five-hopper coal-charging machine, which is similar to the technique described in the preceding examplary embodiment. In this cace it is advisable to assume that all the five hoppers of the coal-charging machine are combined into groups, these groups include two extreme hoppers on the coke, two on the machine side and one central hopper, the charging operation being effected at it is done by means of a three-hopper coal charging machine, or on the contrary all three central hoppers are combined into one group considering said three hoppers as one with coal coming off simultaneously into the coke oven being replenished.

As can be seen from the above examplary embodiments, the proposed method can be realized with the air of a coal-charging machine 2 (FIG. 7, 8) comprising charge hoppers 6, 7, 8, the number of the hoppers on the machine 2 corresponding to that of charging holes 9, 10, 11 of the coke oven 1 which can be equal to three, four, five and more, depending on the oven type. The present invention is illustrated by an embodiment of a three-hopper coal-charging machine and by several hopper embodiments.

The coal-charging machine comprises a frame 20 (FIGS. 7, 8) made as a portal car resting on a carriage 21. The car travels on tracks laid on the top of an oven battery. Each of the hoppers 6, 7, and 8 is fixed on the frame 20 by means of collars 22 and has a receiving device (unit G in FIGS. 7 and 9) and a discharging device (unit R in FIGS. 7 and 10).

The receiving device (unit G in FIGS. 7 and 9) of each hopper comprises a proportioner 23 which is ring-shaped.

The proportioner 23 is secured to the receiving portion of the hopper at the centre of its inlet (FIG. 9) with a possibility of moving axially in a vertical direction. A bottom annular edge of the proportioner 23 shapes the coal cone in the hopper, as shown with a dotted line in FIG 9.

Each hopper of a coal-charging machine 2 must have a gear adapted for opening a gate 24 of a coal bin bunker 25. The gear is fixed on the coal-charging machine hopper and comprises an arm 26 interacting through a rod 27 with a drive (not shown in FIG. 9).

The arm 26 interacts also with an arm 28 which opens the gate 24 of the coal bin bunker 25.

Figure 7:
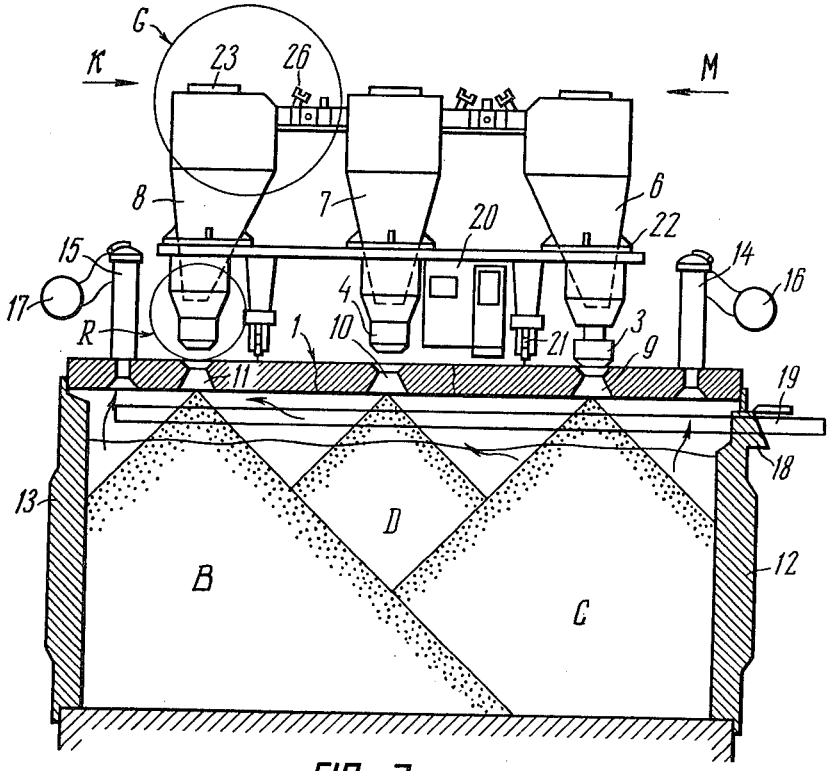
FIG. 7 is a general view of a three-hopper coal-charging machine spotted over the coke-oven being charged, and the charge distribution pattern within the coke oven.
Figure 8:
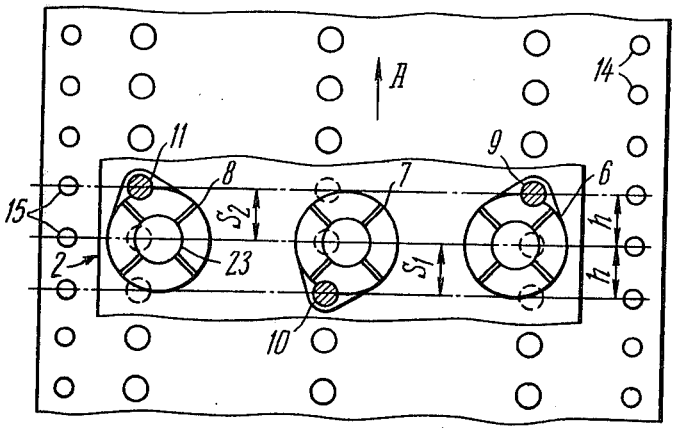
FIG. 8 is a top view of a coal-charging machine shown in FIG. 7.
Figure 10:
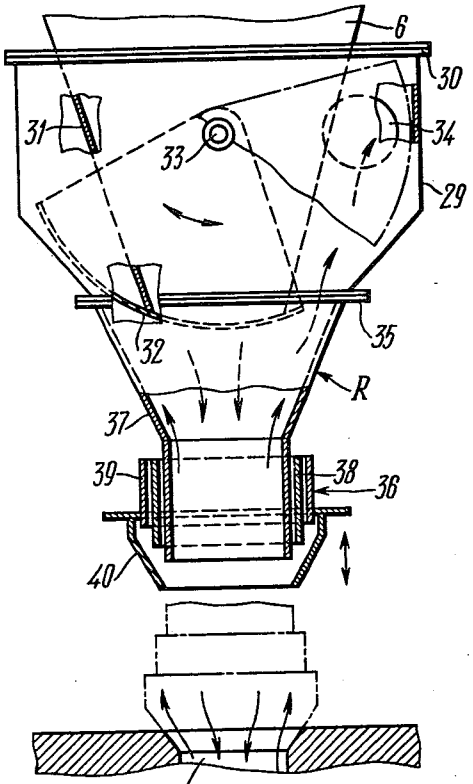
FIG. 10 is a general view of a discharging device of the coal-charging machine hopper element R in FIG. 7.

The bottom portion of each hopper is furnished with a discharging device (unit R in FIGS. 7 and 10). The latter (discharging device R) is set up on a housing 29 that is fixed with its flange 30 on the hopper 6. The housing 29 accommodates a tapered funnel 31 with a round outlet closed by a gate 32. The gate 32 is mounted rotatably on a pivot 33 (shown by arrows). Set up on a side wall of the housing 29 is a gas discharging sleeve 34. Secured on the bottom flange 35 of the housing 29 is a telescopic guiding device 36 through which the hopper 6 of the coal-charging machine is coupled with the charging hole when dropping charge into the oven. The guide portion of said device comprises a flaring cylindrical connecting pipe 37 fixed on the housing 29 and three movable cylindrical connecting pipes: an internal one 38, an intermediate pipe 39 and an external connecting pipe 40. The external connecting pipe 40 has a tapered portion which aids when centering it in the charging hole.

As previously pointed out, the hopper of the coal-charging machine 2 may have various embodiments equally satisfying charging conditions according to the invention.

The mathematical relationship for the relative displacement of the centres of the receiving and discharging devices in all the hoppers holds true for all the hopper embodiments of the coal charging machine. Let $S_1$ (FIGS. 7 and 11 through 18) denote the displacement of the centre of the inlet of the receiving device (unit G) with respect to that of the outlet of the discharging device (unit R) of the central hopper; and $S_2$ (FIGS. 7 and 11 through 18) the displacement of the centre of the inlet of the receiving device (unit G) with respect to that of the outlet of the discharging device (unit R) of the extreme hopper; $K_1$ the coefficient depending on the charging schedule adopted for coke ovens and a multiple of a distance $h$ (FIGS. 11 through 18) between the longitudinal axes of the adjacent coke ovens; and $K_2$ the coefficient taking into account the number of rows of the coal bin gates from which charge is simultaneously dropped into the coal-charging machine hoppers, said coefficient being equal to zero or a multiple of a distance H (FIG. 12) between the axes of the adjacent rows of the coal bin bunkers. Then the displacement of the centre of the inlet of the receiving device with respect to that of the outlet of the discharging device of the central and extreme hoppers will be expressed as:

$$S_1 = K_1h \pm S_2 \pm K_2H,$$

where the product $K_1h$ is the displacement of the outlets of the central hopper with respect to those in the extreme hoppers. The coefficient $2 \leqq K_1 \leqq 5$ is an integer depending on the charging schedule adopted on coke ovens.

The product $K_2H$ is the displacement of the inlet of the central hopper with respect to those of the extreme hoppers. To assure the spotting of two or three machines under the coal bin when loading coal charge or during overhaul periods $0 \leqq K_2 \leqq 4$.

the plus sign before $S_2$ signifies the displacement of the inlets of the extreme hoppers in the direction of machine travel for charging the next oven. The minus sign signifies their displacement in a reverse direction.

Both signs put before $K_2H$ satisfy the relation but preference should be given to a minus sign before $S_2$.

Figure 11:
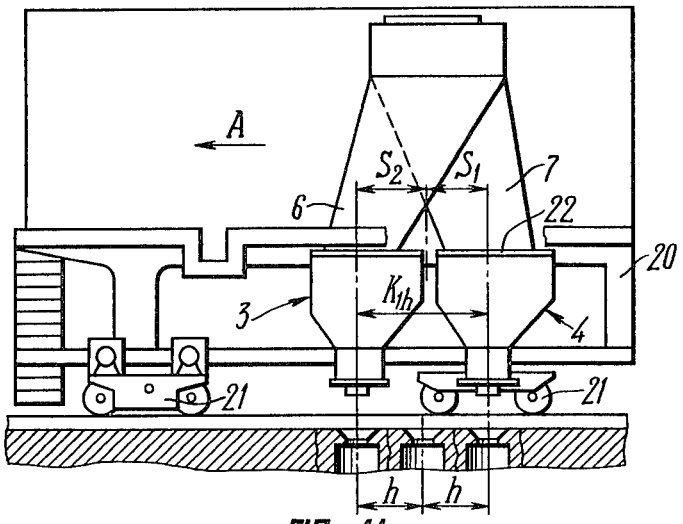
FIG. 11 is a side view of a coal-charging machine and a fragmentary longitudinal section through a coke oven battery.
Figure 12:
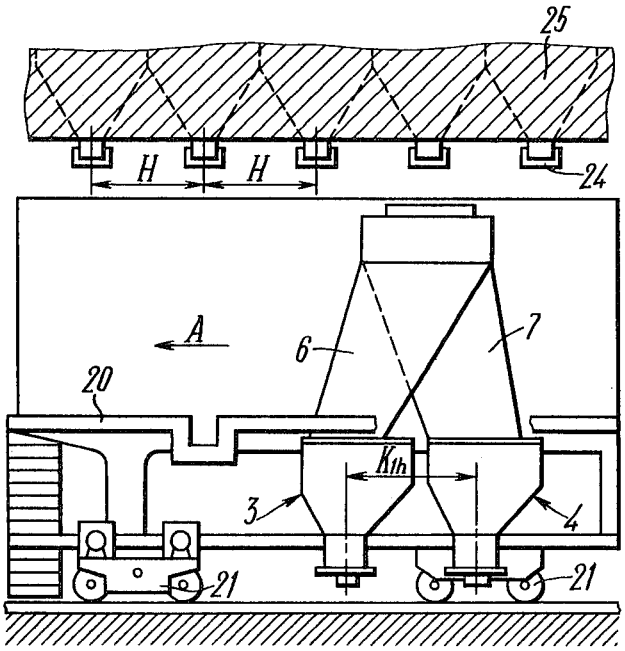
FIG. 12 shows the mutual arrangement of coal bin bunkers and a coal-charging machine while taking coal charge from the coal bin bunkers into the machine hoppers (a side view)
Figure 13:
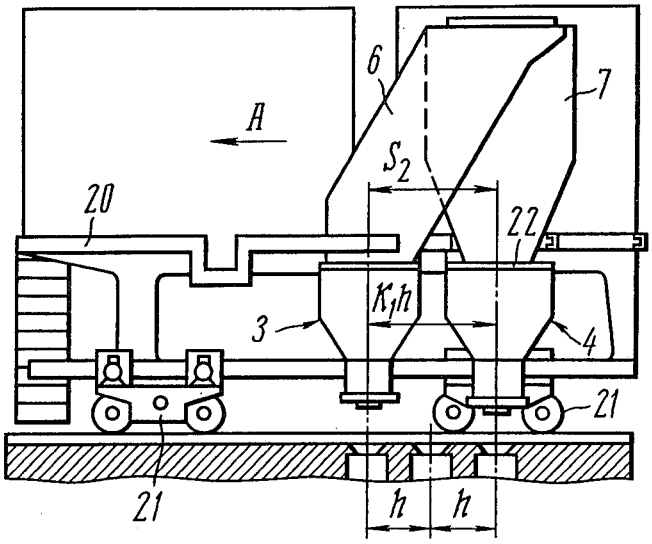
FIG. 13 shows a coal-charging machine with inclined extreme hopper and a vertical central hopper (a side view)
Figure 14:
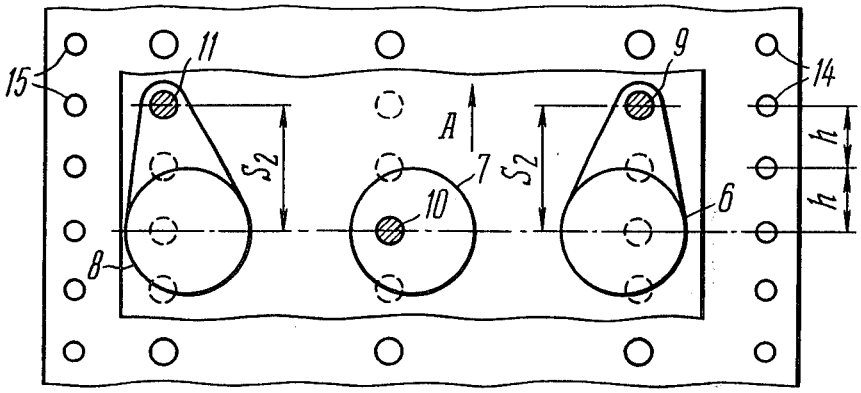
FIG. 14 is a top view of a coal-charging machine of FIG. 13 (with the representation turned through 90°)
Figure 15:
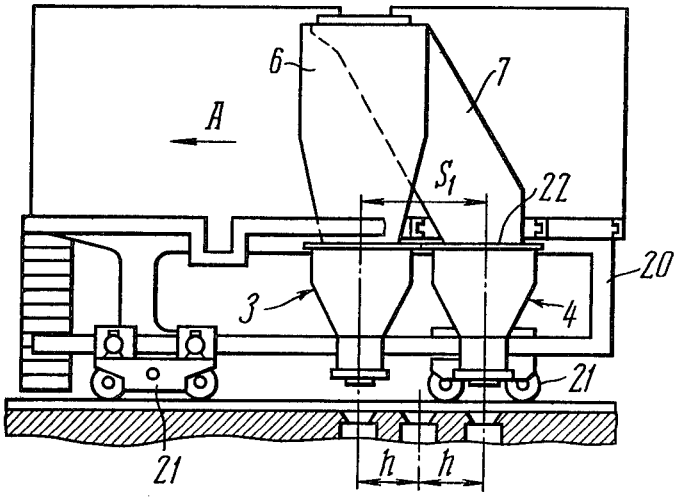
FIG. 15 is a side view of a coal-charging machine with vertical extreme hoppers and an inclined central hopper.
Figure 16:
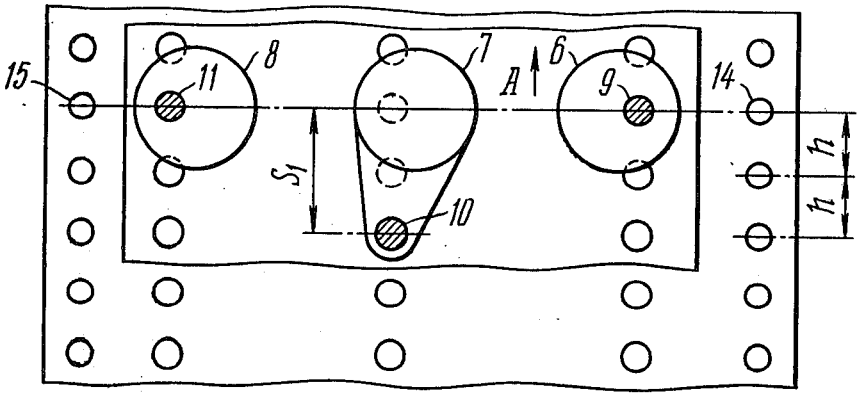
FIG. 16 is the top view of a coal-charging machine of FIG. 15 (with the representation turned through 90°)
Figure 17:
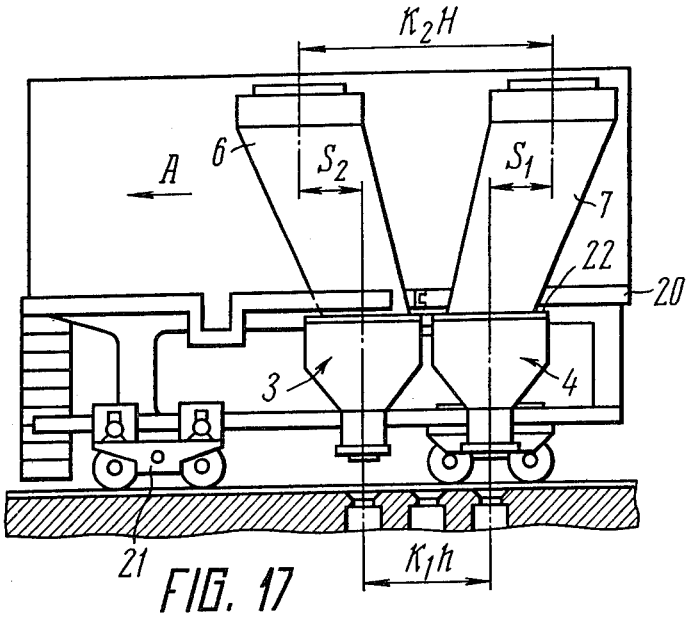
FIG. 17 is a side view of a coal-charging machine with inclined external and central hoppers.
Figure 18:
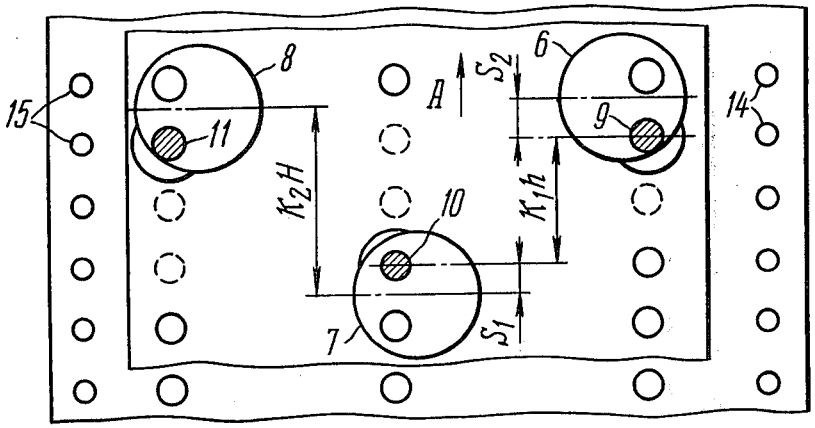
FIG. 18 is a top view of the coal-charging machine of FIG. 17 (with the representation turned through 90°).

The preferred and basic hopper embodiment is a structure shown in FIGS. 7, 11. Each hopper 6, 7, 8 of the coal-charging machine 2 is inclined and is fixed on the machine frame 20 so (FIG. 11) that the centres of the inlets of its receiving devices (unit G) are arranged in one plane passing through the longitudinal axis of the oven, and the centres of the outlets of the discharging devices (unit R) are simmetrically displaced for a distance which is a multiple of the distance *h* between the adjacent ovens. Said hopper design is the simpliest one, the charge comes off easily and can be charged under one row of the coal bin gates (FIG. 12).

It is also expedient, according to the invention, that the central hopper 7 (FIGS. 13, 14) have a flaring cylindrical outline and be placed vertically on the frame 20. The extreme hoppers 6 and 8 are arranged on the frame 20 of the coal charging machine 2 with an inclination so that the centres of the inlets of the receiving devices (unit G) in all the hoppers are disposed on one axis passing in a vertical plane of a coke oven being replenished. The centres of the outlets of the discharging device (unit R) of the extreme hoppers 6 and 8 are displaced with respect to that of the central hopper 7 for a distance multiple of the distance *h* between the two adjacent ovens in the direction of travel of the coal-charging machine moving to the next oven to charge it.

Said hopper embodiment enables the charge to be loaded into the hoppers of the coal-charging machine from one row of the gates of the coal bin and to be discharged therefrom simultaneously into two ovens according to the invention. This results in a simplier design of the central hopper and more efficient utilization of the working stage area of the machine frame 20.

According to the invention, the extreme hoppers 6 and 8 (FIGS. 15, 16) may also have a flaring cylindrical configuration and be mounted on the machine frame 20 vertically. The walls of the central hopper 7 are in this case inclined. According to this embodiment, the inlets of the receiving devices (unit G) of all the hoppers 6, 7, 8 are also located in one plane and the centre of the outlet of the discharging device (unit R) of the central hopper 7 is displaced with respect to those of the discharging devices of the extreme hoppers 6 and 8 for a distance between two ovens. Said embodiment assures the simpliest design of the extreme hoppers 6, 8 and the most favourable conditions for the charge coming off these hoppers 6 and 8 due to their vertical walls.

According to one of possible hoppers embodiments of the coal-charging machine according to the invention, all three hoppers 6, 7, 8 (FIGS. 17, 18) can be interchangeable. The hoppers 6, 7, 8 are similar in shape, namely, they have a flaring cylindrical configuration with inclined walls. The inlets in all the hoppers 6, 7, 8 are displaced with respect to a vertical plane passing midway between the hoppers 6, 7, 8 so that the distance between the inlet axes is multiple of the distance H (FIG. 12) between the adjacent rows of the coal bin bunkers.

As for the centres of the outlets of the discharging devices (unit R) of the hoppers 6, 7, 8, they are displaced with respect to said plane for a value which is a multiple of the distance between the neighboring coke ovens. Said design of the hoppers 6, 7, 8 satisfies similtaneously two-oven charging conditions and allows loading coal into the coal-charging machine hoppers simultaneously from the two rows of the coal bin gates.

The herein-proposed coal charging machine operates in the following manner (FIG. 7).

Figure 9:
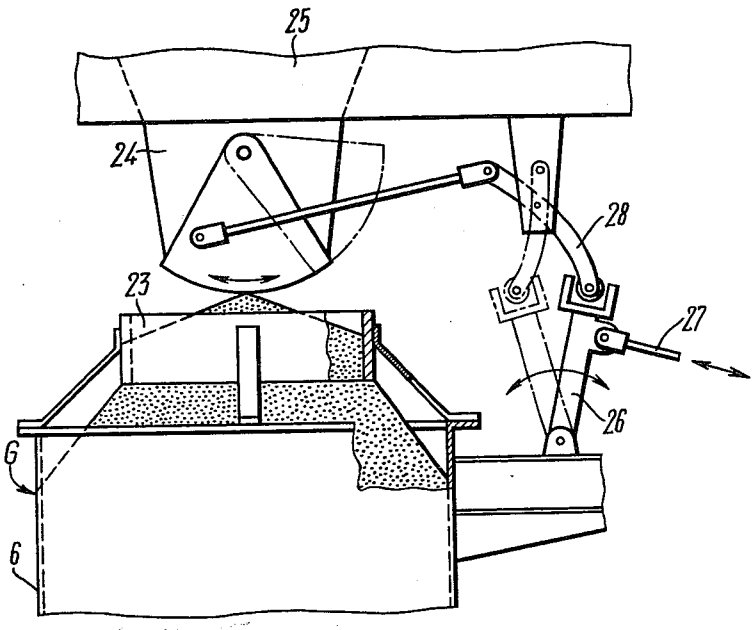
FIG. 9 is the general view of a receiving device of a coal-charging machine hopper element G in FIG. 7.

The cycle is initiated by spotting the coal-charging machine 2 under the selected row of the gates 24 of the coal bin bunkers 25 (FIGS. 9 and 12). The machine is spotted so that the centres of the inlets of the receiving devices of hoppers and proportioners 23 are disposed along the axis of the row of the gates 24. Then a drive (not shown in the drawing) is switched on, said drive turning the arm 26 and opening the gates 24 of the bunkers 25 by means of the arm 28, whereupon the charge flows by gravity into the hoppers 6, 7, 8 of the coal-charging machine. Volumetric control of the coal charge loaded into each hopper 6, 7, 8 is effected by the proportioner 23. In case of charge blockage in the bunkers 25 of the coal bin, the operator cuts in a charge forcing down system provided in the coal bin (not shown in the drawing).

Upon filling each hopper 6, 7, 8 with charge to a preset volume the gate 24 (FIG. 9) of the bunker 25 of the coal bin is closed. To this end the arm 26 is reversed, Supervision of the hopper charging operation, as well as cutting the drives in and out is effected either by the operator of the coal-charging machine or by resorting to a commonly known means.

Following that the coal-charging machine moves over the oven battery to the oven to be charged (that from which resultant coke has been discharged) and stops along its axis so that the centres of the outlets of the discharging devices 3 and 5 (FIG. 7) of the extreme hoppers 6 and 8 coincide with those of the extreme charging holes 11 and 9. Since the outlet of the discharging device 4 of the central hopper 7 is displaced, said outlet will be located above the centre of the central hole 10 of the oven being replenished. Prior to dropping the charge into the coke oven, it is necessary to take off the lids from the charging holes (not shown in the drawing).

Upon uncovering the oven holes, the telescopic pipes 40, 39 and 38 (FIG. 10) are sequentially lowered thereon, as outlined above. Next the gate 32 is set in motion by rotating it about the pivot 33. The opening in the tapered funnel 31 opens and the charge flows by gravity from the hopper of the coal-charging machine into the coke oven. Upon coming in contact with the red hot oven walls, the charge immediately commences to evolve (due to coal destruction) a large amount of gases which escape through oven valleys not filled with charge into the ascension pipes 14 and 15 (FIG. 7). The gas flow is intensified by steam ejection. Some gases rise toward the charge stream and can be withdrawn through a sleeve 34 in the housing 29 (FIG. 10) of the discharging device.

As all the hoppers are completely emptied, as outlined above, the gates 32 of the outlets of the tapered funnel 31 of the hopper discharging devices are closed and the telecopic pipes 38, 39 and 40 are raised, the charging of a coke oven being thus completed. The lids 9, 10, 11 of the charging holes are closed and the coal-charging machine stops again under the coal bin to load the next batch of coal charge into its hoppers. After the coal-charging machine has been spotted under the selected row of the coal bin gates (FIG. 12), the machine operating cycle is completed.

While particular embodiments of the invention have been shown and described hereinbefore, it is not intended that the invention be limited to the disclosed embodiments or to the details thereof and departures may be made therefrom within the spirit and scope of the invention as defined in the claims.

What we claim is:

1. A method of smokeless charging of coke ovens with coal charge, said coke ovens having a plurality of chambers, each of said chambers having at least three charging holes, two of said charging holes being arranged near the extreme ends of each of said chambers and one of said charging holes being arranged in the center of each of said chambers, comprising pouring coal into a first chamber of the coke ovens through its extreme end and central holes from the outlets of a coal-charging machine in two stages, the first of said two stages including positioning a coal-charging machine having at least three outlets, two of said outlets being arranged near the extreme ends of said coal-charging machine and one of said outlets being arranged in the center of said coal-charging machine and displaced from the extreme outlets in the direction of movement of said coal-charging machine, over a first chamber such that the extreme outlets of said coal-charging machine are positioned over the extreme end holes of said first chamber, pouring a coal charge into said first chamber through said extreme end holes, withdrawing charging gases simultaneously through a gas discharge means, advancing said coal-charging machine into a position wherein the extreme outlets of said coal-charging machine are over the extreme end holes of a nearby second chamber which is next in terms of a charging schedule and the central outlet is over the central hole of said first chamber, and simultaneously holding the coal charge in said first chamber over a time period sufficient for said coal-charging machine to advance to said second chamber, the second of said two stages including pouring a coal charge into said first chamber through said central hole, withdrawing charging gases simultaneously through said gas discharge means, and pouring a coal charge through the extreme end holes of said second chamber in terms of said charging schedule simultaneously with the filling of said first chamber through said central hole.

2. The method of claim 1 further comprising levelling said coal charge in said first chamber simultaneously with the filling of said first chamber in terms of the charging schedule, through said central hole.

3. The method of claim 1 comprising pouring coal into each of said extreme end charging holes from said outlets of said coal-charging machine simultaneously.

4. The method of claim 1 comprising pouring coal into said extreme end charging holes from said outlets of said coal-charging machines sequentially.

5. The method of claim 1 further comprising injecting water vapors into said gas discharge means for increasing the gas discharge rate therethrough.

6. The method of claim 1 wherein each step of withdrawing charging gases comprises withdrawing charging gases near each extreme end of each chamber.

7. The method of claim 6 wherein each step of withdrawing charging gases comprises withdrawing the charging gas evolved by the coal pouring through one of said extreme end holes near the other extreme end of the chamber.

* * * * *